US010287968B2

(12) United States Patent
Kaneko et al.

(10) Patent No.: US 10,287,968 B2
(45) Date of Patent: May 14, 2019

(54) ENGINE COOLING SYSTEM

(71) Applicant: TOYOTA JIDOSHA KABUSHIKI KAISHA, Toyota-shi (JP)

(72) Inventors: Rihito Kaneko, Miyoshi (JP); Noboru Takagi, Toyota (JP); Isao Takagi, Okazaki (JP); Naoya Kawamoto, Okazaki (JP); Kenji Kimura, Toyota (JP); Shinji Yumi, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/264,309

(22) Filed: Sep. 13, 2016

(65) Prior Publication Data

US 2017/0074154 A1 Mar. 16, 2017

(30) Foreign Application Priority Data

Sep. 16, 2015 (JP) ..... 2015-183239

(51) Int. Cl.

| | |
|---|---|
| ***F01P 7/16*** | (2006.01) |
| ***F01P 11/18*** | (2006.01) |
| ***F01P 7/14*** | (2006.01) |

(52) U.S. Cl.

CPC ..... *F01P 11/18* (2013.01); *F01P 7/14* (2013.01); *F01P 2007/146* (2013.01)

(58) Field of Classification Search

CPC ... B60H 1/00885; F01P 3/20; F01P 2007/146; F01P 7/14; F01P 2060/00; F01P 7/00; F02F 1/10; F02F 1/36; F02M 26/30; F16K 11/07; F16K 1/12; F16K 31/535

See application file for complete search history.

(56) References Cited

U.S. PATENT DOCUMENTS 2,743,739 A * 5/1956 Mansen ..... F16K 11/0743 137/599.16
5,529,026 A * 6/1996 Kurr ..... B60H 1/00485 123/41.1

(Continued)

FOREIGN PATENT DOCUMENTS

CN 104411941 A 3/2015
JP 4-370317 A 12/1992

(Continued)

*Primary Examiner* — Long T Tran
(74) *Attorney, Agent, or Firm* — Oblon, McClelland, Maier & Neustadt, L.L.P.

(57) ABSTRACT

An engine cooling system includes a coolant circuit, a multi-way valve, a relief route and a relief valve. The coolant circuit includes a first route and a second route into which the coolant circuit is branched off at a branched position. The first route passes through a radiator. The multi-way valve is provided at the branched position. The relief route sets a relief source to a portion downstream of a pump and upstream of the multi-way valve in the coolant circuit, sets a relief destination to a portion downstream of the radiator in the first route, and causes coolant to flow from the relief source to the relief destination so as to bypass the multi-way valve. The relief valve interrupts circulation of coolant through the relief route when the relief valve is closed, and permits circulation of coolant through the relief route when the relief valve is open.

5 Claims, 8 Drawing Sheets

(56) References Cited

U.S. PATENT DOCUMENTS

| | | | | |
|---|---|---|---|---|
| 6,371,060 | B1 * | 4/2002 | Lehmann | F01P 7/167 123/41.1 |
| 6,539,899 | B1 * | 4/2003 | Piccirilli | F01P 7/167 123/41.08 |
| 6,745,726 | B2 * | 6/2004 | Joyce | F01P 7/164 123/41.1 |
| 6,920,845 | B2 * | 7/2005 | Lelkes | F01P 7/167 123/41.01 |
| 7,165,513 | B2 * | 1/2007 | Humburg | B60H 1/00485 123/41.08 |
| 8,464,668 | B2 * | 6/2013 | DiPaola | F01P 7/165 123/196 AB |
| 9,115,634 | B2 * | 8/2015 | Triebe | F01P 7/161 |
| 2004/0016411 | A1 * | 1/2004 | Joyce | F01P 7/164 123/41.1 |
| 2005/0034688 | A1 * | 2/2005 | Lelkes | F01P 7/167 123/41.01 |
| 2008/0034688 | A1 * | 2/2008 | Neuhofer, Jr. | E04F 15/02027 52/290 |
| 2013/0221116 | A1 * | 8/2013 | Tsuchiya | F01P 7/14 236/34.5 |
| 2015/0122359 | A1 * | 5/2015 | Tsuchiya | F01P 7/16 137/625.47 |
| 2015/0144078 | A1 * | 5/2015 | Hutchins | F01P 7/165 123/41.1 |

FOREIGN PATENT DOCUMENTS

| | | |
|---|---|---|
| JP | 2010-174712 | 8/2010 |
| JP | 2014-152639 | 8/2014 |
| JP | 2015-10577 | 1/2015 |

* cited by examiner

ENGINE COOLING SYSTEM

INCORPORATION BY REFERENCE

The disclosure of Japanese Patent Application No 2015-183239 filed on Sep. 16, 2015 including the specification, drawings and abstract is incorporated herein by reference in its entirety.

BACKGROUND OF THE INVENTION

1. Field of the Invention

The invention relates to an engine cooling system that cools an engine by circulating coolant through the inside of the engine.

2. Description of Related Art

In a liquid-cooled engine, the engine is cooled by circulating coolant between the inside of the engine and a radiator with the use of a pump. Conventionally, as described in Japanese Patent Application Publication No. 2015-010577 (JP 2015-010577 A), there is such a cooling system for a liquid-cooled engine, in which a coolant circuit through which coolant is circulated branches off into a plurality of routes outside the engine, the plurality of routes including a radiator route that passes through a radiator, and a multi-way valve is provided at the branched position of those routes so as to be able to vary the flow rate ratio of coolant flowing into the routes. Such an engine cooling system is able to adjust the cooling capacity of the cooling system as needed in response to an operating condition of the engine. For example, before completion of warm-up of the engine, the cooling capacity of the cooling system is allowed to be decreased by the multi-way valve being controlled such that the flow rate of coolant passing through the radiator reduces, with the result that warm-up of the engine is facilitated. For example, when the amount of heat generated from the engine is large, the cooling capacity of the cooling system is allowed to be increased by the multi-way valve being controlled such that the flow rate of coolant passing through the radiator increases.

Incidentally, in an engine cooling system including a multi-way valve as described above, if the total flow rate of coolant passing through the multi-way valve is continuously smaller than the coolant discharge amount of the pump, the pressure of coolant at a portion upstream of the multi-way valve in the coolant circuit may excessively increase. For this reason, in such an engine cooling system, any portion of the coolant circuit is required to have a high pressure resistance in consideration of an increase in pressure in such a case, so higher pressure-resistant and more expensive components are required. This leads to an increase in manufacturing cost.

SUMMARY OF THE INVENTION

The invention provides an engine cooling system that is able to suitably prevent an excessive increase in coolant pressure.

A first aspect of the invention provides an engine cooling system. The engine cooling system includes: a coolant circuit through which coolant flows from a pump, passes through an inside of an engine and returns to the pump, the coolant circuit including a first route and a second route into which the coolant circuit is branched off at a branched position downstream of the inside of the engine, each of the first route and the second route being connected to the pump, the first route being a radiator route that passes through a radiator; a multi-way valve that is provided at the branched position at which the coolant circuit is branched off into the first route and the second route and that is able to vary a flow rate ratio of coolant flowing into each of the first and second routes; a relief route that sets a relief source to a portion downstream of the pump and upstream of the multi-way valve in the coolant circuit, that sets a relief destination to a portion downstream of the multi-way valve and upstream of the pump in the coolant circuit, and that causes coolant to flow from the relief source to the relief destination so as to bypass the multi-way valve; and a relief valve that interrupts circulation of coolant through the relief route when the relief valve is closed, and that permits circulation of coolant through the relief route when the relief valve is open.

With the thus configured engine cooling system, even when flow of coolant stagnates at the multi-way valve and the pressure of coolant at a portion upstream of the multi-way valve increases, it is possible to relieve the increased pressure by opening the relief valve to let coolant to escape from a portion upstream of the multi-way valve to a portion downstream of the multi-way valve through the relief route. However, if coolant that has passed through the relief route is configured to flow into the radiator, coolant constantly flows into the radiator through the relief route when the relief valve is stuck open, so there is a concern that the engine is cooled more than necessary. In terms of this point, with the engine cooling system, the relief destination of the relief route is set to a portion downstream of the multi-way valve and upstream of the pump in the coolant circuit and other than a portion upstream of the radiator in the radiator route. For this reason, even when the relief valve is stuck open, coolant does not constantly flow into the radiator, and excessive cooling of the engine due to the constant flow of coolant into the radiator also does not occur. That is, with the engine cooling system, an excessive increase in coolant pressure at a portion upstream of the multi-way valve is prevented, and the engine is not excessively cooled even when the relief valve installed for the purpose of preventing an excessive increase in coolant pressure is stuck open. Therefore, with the engine cooling system, it is possible to suitably prevent an excessive increase in coolant pressure.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, a first embodiment of an engine cooling system will be described in detail with reference to FIG. 1 to FIG. 6. Initially, the configuration of a coolant circuit through which coolant for cooling an engine flows in the engine cooling system according to the present embodiment will be described with reference to FIG. 1.

Figure 1:
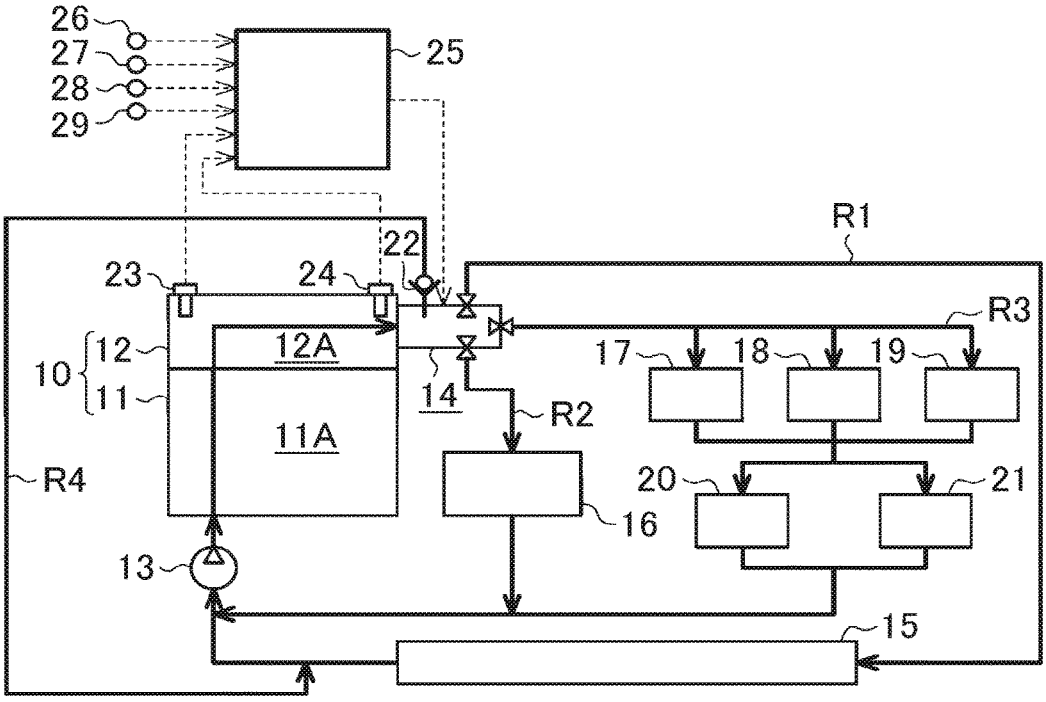
FIG. 1 is a schematic diagram that schematically shows the configuration of an engine cooling system according to a first embodiment.

As shown in FIG. 1, water jackets 11A, 12A, which are part of the coolant circuit, are respectively provided in a cylinder block 11 and cylinder head 12 of the engine 10. A coolant pump 13 for circulating coolant through the coolant circuit is provided at a portion upstream of the water jackets 11A, 12A in the coolant circuit. A mechanical pump that is driven by power transmitted from the engine 10 is employed as the coolant pump 13. Coolant discharged from the coolant pump 13 is introduced into the water jackets 11A, 12A.

An inlet coolant temperature sensor 23 is provided in the water jacket 12A of the cylinder head 12. The inlet coolant temperature sensor 23 detects the temperature of coolant just after flowing from the water jacket 11A of the cylinder block 11 into the water jacket 12A of the cylinder head 12 (inlet coolant temperature). An outlet coolant temperature sensor 24 is also provided in the water jacket 12A. The outlet coolant temperature sensor 24 detects the temperature of coolant just before flowing out from the water jacket 12A to the outside.

A multi-way valve 14 is attached to a portion at which a coolant outlet of the water jacket 12A is provided in the cylinder head 12. Coolant that has passed through the water jackets 11A, 12A flows into the multi-way valve 14. The coolant circuit branches off at the multi-way valve 14 into three routes, that is, a radiator route R1, a heater route R2 and a device route R3. Among these routes, the radiator route R1 is a route for supplying coolant to a radiator 15 that cools coolant by exchanging heat with outside air. The heater route R2 is a route for supplying coolant to a heater core 16 that is a heat exchanger for heating air, which is blown into a vehicle cabin, with heat of coolant at the time of heating the vehicle cabin. The device route R3 is a route for supplying coolant to devices to which heat of the engine 10 is transferred by coolant as a carrier medium. The flow passage cross-sectional area of the radiator route R1 is larger than the flow passage cross-sectional area of each of the heater route R2 and the device route R3 such that a larger amount of coolant can flow.

The radiator route R1 supplies coolant to the radiator 15, and is then connected to the coolant pump 13 at a portion downstream of the radiator 15. The device route R3 initially branches off into three routes, and the branched routes respectively supply coolant to a throttle body 17, an exhaust gas recirculation (EGR) valve 18 and an EGR cooler 19. The three branched routes of the device route R3 once merge at the downstream side of those throttle body 17, EGR valve 18 and EGR cooler 19, then the merged route branches off into two routes, and the branched two routes respectively supply coolant to an oil cooler 20 and an automatic transmission fluid (ATF) warmer 21. The two branched routes of the device route R3 merge again at the downstream side of the oil cooler 20 and ATF warmer 21. The device route R3 merges into a portion downstream of the radiator 15 in the radiator route R1 at a portion downstream of the merged position of the two branched routes of the device route R3, and is connected to the coolant pump 13 in a state where the device route R3 is integrated with the radiator route R1.

On the other hand, the heater route R2 supplies coolant to the heater core 16, then merges into a portion downstream of the oil cooler 20 and ATF warmer 21 in the device route R3 at a portion downstream of the heater core 16 to be integrated with the device route R3, also integrated with the radiator route R1 at a further downstream side, and is connected to the coolant pump 13.

As described above, the coolant circuit is configured to cause coolant to flow from the coolant pump 13, pass through the inside (water jackets 11A, 12A) of the engine 10 and return to the coolant pump 13. The coolant circuit includes a plurality of routes into which the coolant circuit is branched off at a branched position downstream of the inside of the engine 10. Each of the plurality of routes is connected to the coolant pump 13. The plurality of routes are three routes, that is, the radiator route R1, the heater route R2 and the device route R3. The multi-way valve 14 is provided at the branched position at which the coolant circuit is branched off into the three routes R1 to R3. The multi-way valve 14 is able to vary the flow rate ratio of coolant flowing into each of those routes R1 to R3.

The engine cooling system according to the present embodiment includes a relief structure for, when the pressure of coolant upstream of the multi-way valve 14 has excessively increased, relieving the pressure. The relief structure includes a relief valve 22 and a relief route R4. The relief route R4 is provided such that a portion downstream of the coolant pump 13 and upstream of the multi-way valve 14 in the coolant circuit is set for a relief source, a portion downstream of the multi-way valve 14 and upstream of the coolant pump 13 in the coolant circuit is set for a relief destination and coolant is caused to flow from the relief source to the relief destination so as to bypass the multi-way valve 14. The relief valve 22 interrupts circulation of coolant through the relief route R4 when the relief valve 22 is closed, and permits circulation of coolant through the relief route R4 when the relief valve 22 is open. In this engine cooling system, a differential pressure regulating valve that opens or closes in response to a differential pressure of coolant between the relief source and the relief destination is employed as the relief valve 22. The relief valve 22 is incorporated in the multi-way valve 14. The relief route R4 is provided so as to start from the multi-way valve 14 and merge into a portion downstream of the radiator 15 in the radiator route R1. That is, in this engine cooling system, the relief destination of the relief route R4 is set to a portion downstream of the radiator 15 in the radiator route R1.

The multi-way valve 14 is controlled by an electronic control unit 25 that governs engine control. The electronic control unit 25 includes a central processing unit, a read only memory and a read/write random access memory. The central processing unit executes various arithmetic processing associated with engine control. Programs and data for control are stored in the read only memory in advance. The read/write random access memory temporarily stores computed results of the central processing unit, detected results of sensors, and the like. Detected signals of sensors provided at various portions of the vehicle are input to the electronic control unit 25. The sensors include a crank angle sensor 26, an air flow meter 27, an outside air temperature sensor 28, a vehicle speed sensor 29, and the like, in addition to the above-described inlet coolant temperature sensor 23 and outlet coolant temperature sensor 24. The crank angle sensor 26 detects the rotational phase (crank angle) of a crankshaft that is the output shaft of the engine 10. The electronic control unit 25 computes the rotation speed of the engine 10 (engine rotation speed) on the basis of the detected crank angle. The air flow meter 27 detects the intake air amount of the engine 10. The outside air temperature sensor 28 detects the temperature of air outside the vehicle (outside air temperature). The vehicle speed sensor 29 detects the traveling speed of the vehicle (vehicle speed). An IG signal is also input to the electronic control unit 25. The IG signal indicates whether an ignition switch is in an on state or in an off state.

Subsequently, the configuration of the multi-way valve 14 provided in the coolant circuit of the thus configured engine cooling system will be described with reference to FIG. 2 to FIG. 5B. In the following description, the direction indicated by the arrow U is defined as the upper side of the multi-way valve 14 and the direction indicated by the arrow D is defined as the lower side of the multi-way valve 14 in FIG. 2 to FIG. 5B.

Figure 2:
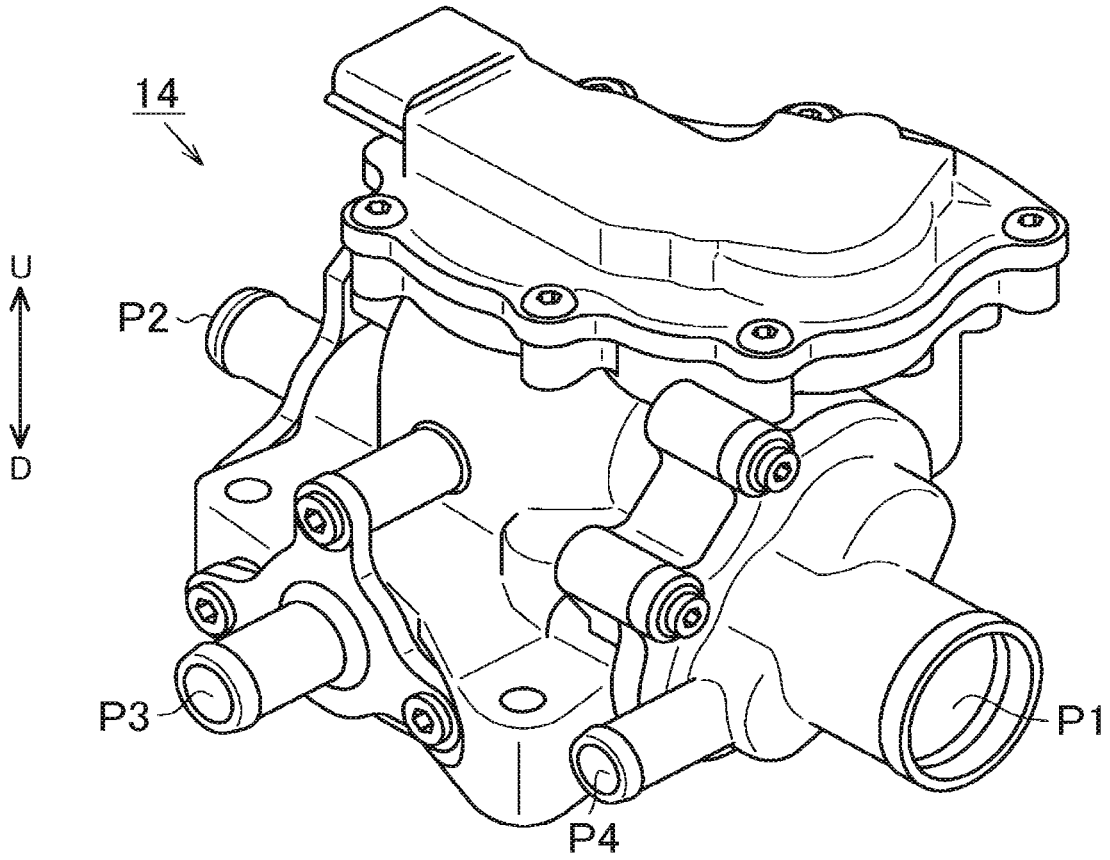
FIG. 2 is a perspective view of a multi-way valve provided in the engine cooling system.

As shown in FIG. 2, the multi-way valve 14 includes four discharge ports that serve as discharge ports of coolant, that is, a radiator port P1, a heater port P2, a device port P3 and a relief port P4. When the multi-way valve 14 is assembled to the engine 10, the radiator port P1 is connected to the radiator route R1, the heater port P2 is connected to the heater route R2, the device port P3 is connected to the device route R3 and the relief port P4 is connected to the relief route R4.

Figure 3:
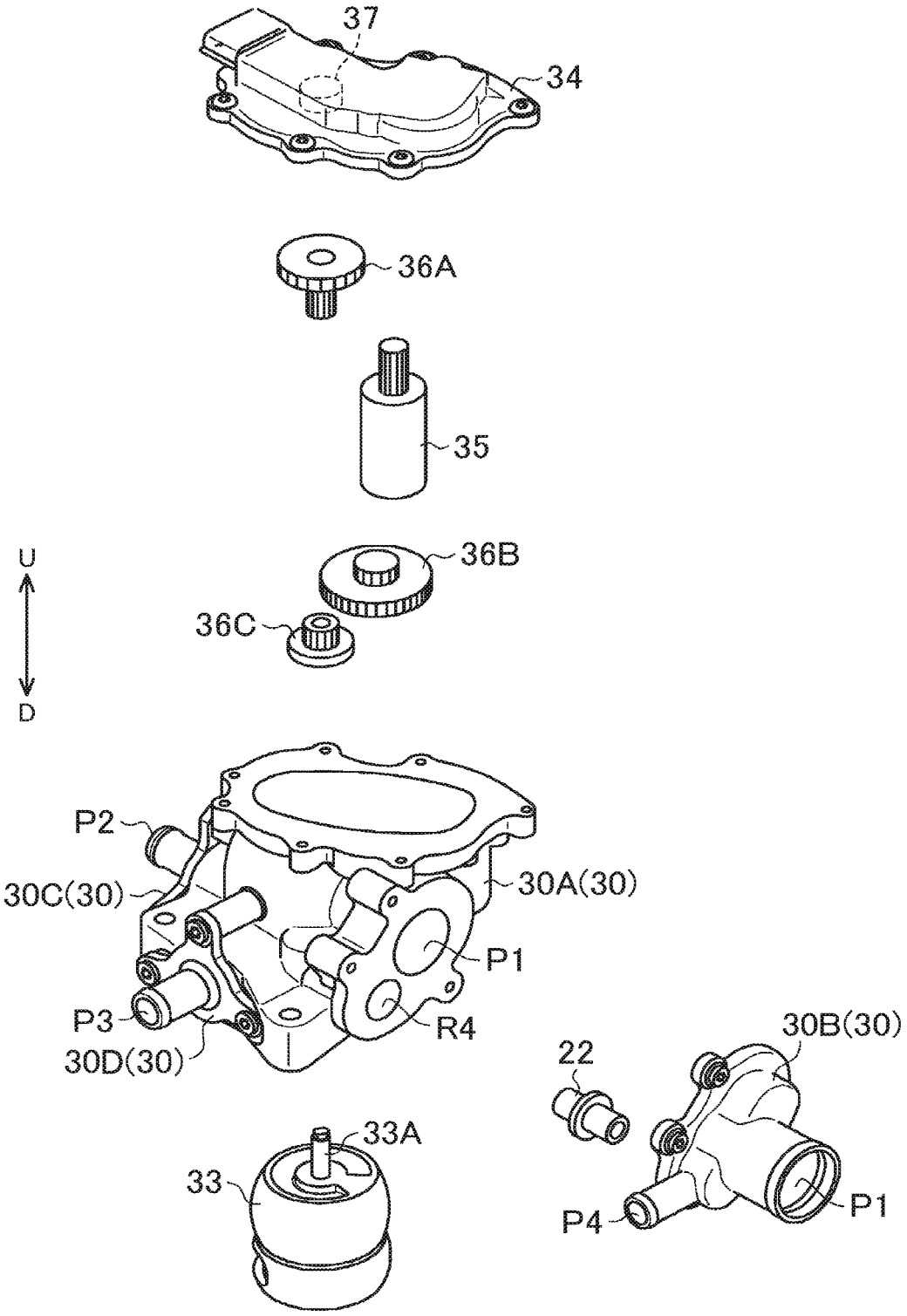
FIG. 3 is an exploded perspective view of the multi-way valve.

As shown in FIG. 3, the multi-way valve 14 includes a housing 30, a valve element 33, a cover 34, a motor 35, and a reduction gear mechanism consisting of three gears 36A to 36C, as its components. The housing 30 that constitutes the framework of the multi-way valve 14 includes the above-described four discharge ports P1 to P4. The housing 30 is split into a main body 30A and connector portions 30B to 30D to which the routes R1 to R4 are respectively connected. Specifically, the radiator route R1 and the relief route R4 are connected to the connector portion 30B, the heater route R2 is connected to the connector portion 30C and the device route R3 is connected to the connector portion 30D. FIG. 3 shows the housing 30 in a state where the connector portion 30B is separated from the main body 30A.

The valve element 33 is accommodated at the lower portion of the main body 30A of the housing 30. The valve element 33 is able to vary the opening areas of the three discharge ports, that is, the radiator port P1, the heater port P2 and the device port P3 in accordance with rotation. The motor 35 and the reduction gear mechanism are accommodated at the upper portion of the main body 30A of the housing 30. The motor 35 is accommodated in the housing 30 in a state where the motor 35 is coupled to a valve shaft 33A that is the rotary shaft of the valve element 33 via the gears 36A to 36C that constitute the reduction gear mechanism. Thus, the rotation of the motor 35 is reduced in speed and is then transmitted to the valve element 33.

On the other hand, the cover 34 is attached to the housing 30 so as to cover the upper side of the portion in which the motor 35 and the reduction gear mechanism are accommodated. A valve phase sensor 37 is attached to the inside of the cover 34. The valve phase sensor 37 is used to detect the relative rotational phase (hereinafter, referred to as valve phase) of the valve element 33 with respect to the housing 30. A detected signal of the valve phase sensor 37 is input to the above-described electronic control unit 25. The above-described relief valve 22 is also accommodated inside the housing 30.

Figure 4:
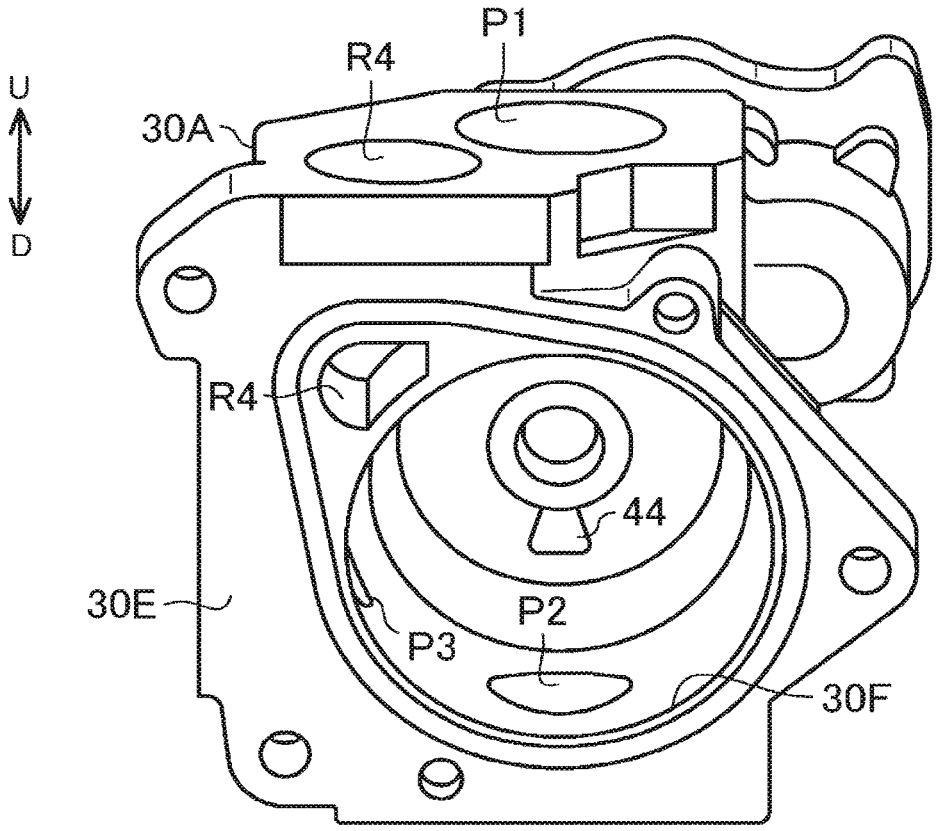
FIG. 4 is a perspective view of the main body of a housing that is a component of the multi-way valve.

FIG. 4 shows the perspective structure of the main body 30A of the housing 30 when viewed from the lower side. The lower face of the main body 30A serves as a fitting face 30E to the cylinder head 12. The multi-way valve 14 is assembled to the engine 10 in a state where the fitting face 30E is in contact with the outer wall of the cylinder head 12. An accommodation space for the valve element 33 in the main body 30A is open at the fitting face 30E, and this opening serves as an inflow port 30F through which coolant flows in from the water jacket 12A of the cylinder head 12. The radiator port P1, the heater port P2 and the device port P3 each are open at the inner side of the housing 30 to the accommodation space for the valve element 33. On the other hand, the relief port P4 is provided so as to be open to the inflow port 30F without intervening the accommodation space for the valve element 33. The relief valve 22 is installed at the relief port P4.

Figure 5A:
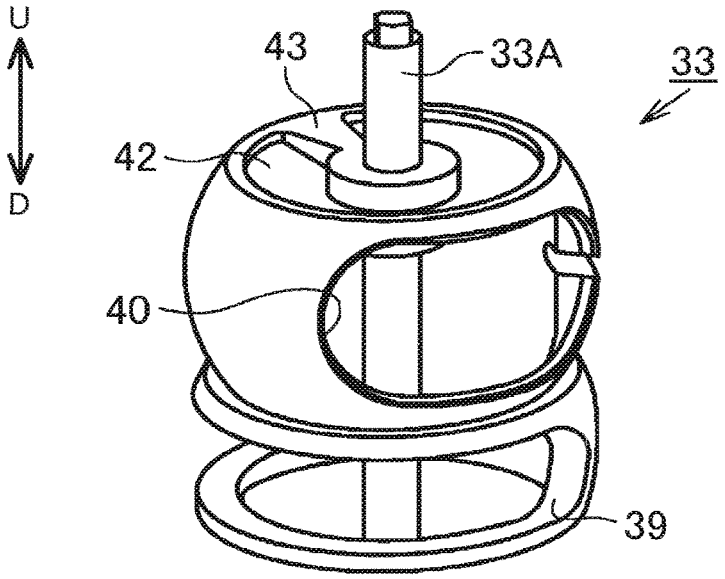
FIG. 5A is a perspective view of a valve element that is a component of the multi-way valve.
Figure 5B:
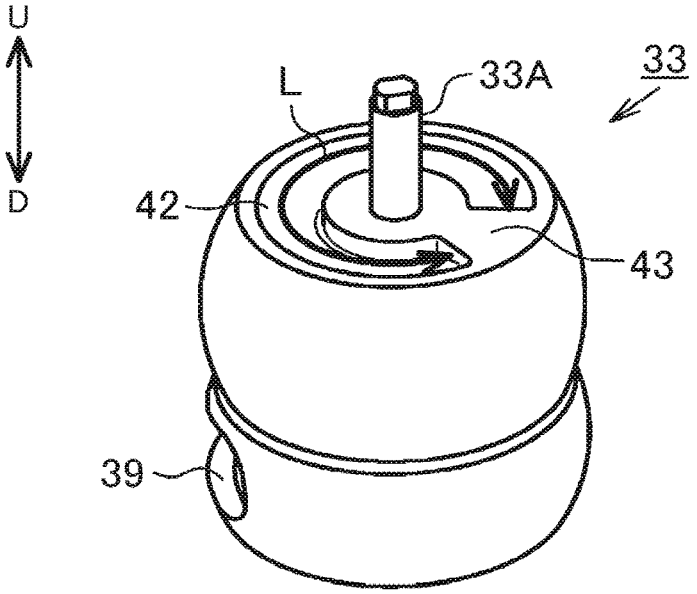
FIG. 5B is a perspective view of the valve element when viewed from another side.

As shown in FIG. 5A, the valve element 33 has such a shape that two barrel-shaped objects are superimposed on top of each other. The valve element 33 includes the valve shaft 33A that protrudes upward from the center of the upper face of the valve element 33. The valve element 33 has such a hollow structure that an opening that communicates with the inflow port 30F is provided at the lower face when the valve element 33 is accommodated in the housing 30. Two holes 39, 40 through which coolant is communicable are respectively provided at the side peripheries of the two barrel-shaped portions of the valve element 33.

In a state where the valve element 33 is accommodated in the housing 30, the hole 39 provided at the lower portion of the valve element 33 communicates with at least one of the heater port P2 and the device port P3 when the valve phase falls within a certain range. The hole 40 provided at the upper portion of the valve element 33 communicates with the radiator port P1 when the valve phase falls within another range. Each of the discharge ports P1 to P3 closes when the valve element 33 is located at a position at which the discharge port does not overlap with the corresponding hole 39 or hole 40 at all, and blocks coolant from being discharged to the connected one of the routes R1 to R3. Each of the discharge ports P1 to P3 opens when the valve element 33 is located at a position at which part or all of the discharge port overlaps with the corresponding hole 39 or hole 40, and permits coolant to be discharged to the connected one of the routes R1 to R3. For information, the relief port P4 is in a constantly fully open state irrespective of the valve phase of the multi-way valve 14.

A groove 42 is provided at the upper face of the valve element 33. The groove 42 extends in a circular arc shape so as to surround the base portion of the valve shaft 33A. Part of the upper face of the valve element 33 is left without a groove, and functions as a stopper 43. On the other hand, as shown in FIG. 4, a stopper 44 is provided at the back of the accommodation space for the valve element 33 in the housing 30. The stopper 44 is accommodated in the groove 42 when the valve element 33 is accommodated. A rotational range of the valve element 33 is limited within the housing 30 by the contact of those stoppers 43, 44 with each other. That is, a rotation of the valve element 33 inside the housing 30 is permitted as long as movement of the stopper 44 inside the groove 42 falls within the range indicated by the arrow L in FIG. 5B.

Figure 6:
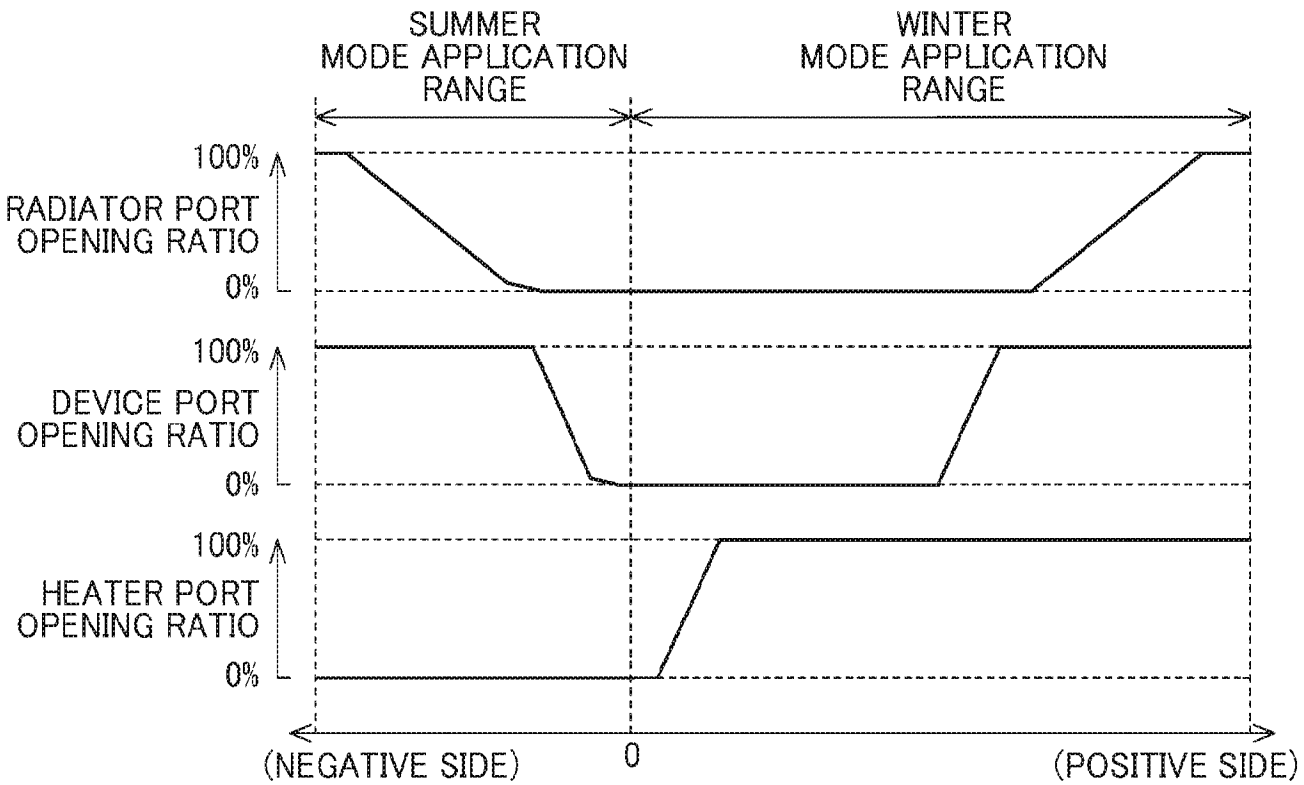
FIG. 6 is a graph that shows the relationship between a valve phase of the multi-way valve and an opening ratio of each of discharge ports.

FIG. 6 shows the relationship between a valve phase of the multi-way valve 14 and an opening ratio of each of the discharge ports P1 to P3. Where the position at which all the discharge ports P1 to P3 are in a closed state is a position at which the valve phase is 0°, the valve phase indicates the rotational angle of the valve element 33 from that position in a clockwise direction (positive direction) when viewed from above and in a counter clockwise direction (negative direction) when viewed from above. Where the opening ratio in a fully open state is 100%, the opening ratio indicates the ratio of the opening area of each of the discharge ports P1 to P3.

As shown in FIG. 6, the opening ratio of each of the discharge ports P1 to P3 is set so as to vary with the valve phase of the valve element 33. The range of the valve phase on the positive side with respect to the position at which the valve phase is 0° is defined as the range of the valve phase, which is used at the time when the vehicle cabin is heated (winter mode application range). The range of the valve phase on the negative side with respect to the position at which the valve phase is 0° is defined as the range of the valve phase, which is used at the time when the vehicle cabin is not heated (summer mode application range).

As the valve element 33 is rotated from the position at which the valve phase is 0° in the positive direction, the heater port P2 initially begins to open, and the opening ratio of the heater port P2 gradually increases with an increase in the valve phase in the positive direction. As the heater port P2 fully opens, that is, the opening ratio of the heater port P2 reaches 100%, the device port P3 subsequently begins to open, and the opening ratio of the device port P3 gradually increases with an increase in the valve phase in the positive direction. As the device port P3 fully opens, that is, the opening ratio of the device port P3 reaches 100%, the radiator port P1 begins to open, and the opening ratio of the radiator port P1 gradually increases with an increase in the valve phase in the positive direction. The opening ratio of the radiator port P1 reaches 100% at a position before the position at which a further rotation of the valve element 33 in the positive direction is restricted by the contact of the stoppers 43, 44 with each other.

On the other hand, as the valve element 33 is rotated in the negative direction from the position at which the valve phase is 0°, the device port P3 initially begins to open, and the opening ratio of the device port P3 gradually increases with an increase in the valve phase in the negative direction. The radiator port P1 begins to open from a position slightly before the position at which the device port P3 fully opens, that is, the opening ratio of the device port P3 reaches 100%, and the opening ratio of the radiator port P1 gradually increases with an increase in the valve phase in the negative direction. The opening ratio of the radiator port P1 reaches 100% at a position before a further rotation of the valve element 33 in the negative direction is restricted by the contact of the stoppers 43, 44 with each other. For information, in the summer mode application range on the negative side with respect to the position at which the valve phase is 0°, the heater port P2 is constantly fully closed.

Next, control over the multi-way valve 14 by the electronic control unit 25 will be described. The electronic control unit 25 controls the multi-way valve 14 as follows before completion of warm-up of the engine 10, that is, when the outlet coolant temperature is lower than a prescribed warm-up completion temperature. That is, when the outlet coolant temperature is lower than a prescribed stop coolant completion temperature (<warm-up completion temperature), the electronic control unit 25 controls the multi-way valve 14 at a cold start of the engine 10 such that the valve element 33 is located at the position at which the valve phase is 0°, that is, all the opening ratios of the discharge ports P1 to P3 are 0%. Thus, an increase in the temperature of the cylinder wall face is facilitated by executing so-called coolant stop control. In the coolant stop control, an outflow of coolant from the inside of the engine 10 is blocked off. As the outlet coolant temperature exceeds the stop coolant completion temperature, the electronic control unit 25 increases the valve phase to the positive side or the negative side with an increase in the outlet coolant temperature. At this time, if the outside air temperature is lower than or equal to a reference temperature and a heater is highly likely to be used, the valve phase is increased to the positive side. If the outside air temperature exceeds the reference temperature and the heater is less likely to be used, the valve phase is increased to the negative side. At this time, the valve phase is increased such that the valve element 33 is located at a position just before the radiator port P1 begins to open at a point in time at which the outlet coolant temperature has reached the warm-up completion temperature.

As warm-up of the engine 10 completes, the electronic control unit 25 starts feedback control over the outlet coolant temperature. This feedback control is executed by adjusting the valve phase of the multi-way valve 14 in response to a deviation between the outlet coolant temperature and a target coolant temperature set on the basis of the operating state of the engine 10. Specifically, when the outlet coolant temperature is higher than the target coolant temperature, the valve phase is gradually varied so as to increase the opening ratio of the radiator port P1; whereas, when the outlet coolant temperature is lower than the target coolant temperature, the valve phase is gradually varied so as to reduce the opening ratio of the radiator port P1.

Next, the operation of the thus configured engine cooling system according to the present embodiment will be described. In the engine cooling system, when all the opening ratios of the discharge ports P1 to P3 of the multi-way valve 14 are small in a state where the rotation speed of the engine 10 is high and the amount of coolant discharged from the coolant pump 13 is large, the pressure of coolant at a portion upstream of the multi-way valve 14 (hereinafter, referred to as multi-way valve upstream side) in the coolant circuit increases. As the coolant pressure at the multi-way valve upstream side becomes higher to a certain extent, the relief valve 22 opens to open the relief route R4, and the increased coolant pressure at the multi-way valve upstream side is relieved to the relief destination of the relief route R4. Thus, leakage of coolant, or the like, due to an excessive increase in coolant pressure at the multi-way valve upstream side is prevented.

If prevention of an excessive increase in coolant pressure at the multi-way valve upstream side is just taken into consideration, the relief destination of the relief route R4 may be set to any portion as long as the portion is located downstream of the multi-way valve 14 and upstream of the coolant pump 13 in the coolant circuit. However, in the engine cooling system according to the present embodiment, the relief destination of the relief route R4 is set to the portion downstream of the radiator 15 in the radiator route R1 because of the following reason.

It is conceivable that the relief valve 22 is stuck open due to involvement of foreign matter, or the like. In such a case, the relief route R4 is constantly open, and coolant flows through the relief route R4 irrespective of the open/closed state of the multi-way valve 14. If coolant that has passed through the relief route R4 is configured to flow into the radiator 15, coolant constantly flows into the radiator 15 through the relief route R4 when the relief valve 22 is stuck open, so there is a concern that the engine 10 is cooled more than necessary. That is, even in a period before completion of warm-up of the engine 10, during which coolant is principally not supplied to the radiator 15, coolant is supplied to the radiator 15 and is cooled, so warm-up of the engine 10 delays. Coolant in an amount larger than a principal amount is supplied to the radiator 15 even after completion of warm-up of the engine 10, so the engine 10 is cooled more than necessary.

In terms of this point, with the engine cooling system according to the present embodiment, in which the portion downstream of the radiator 15 in the radiator route R1 is set for the relief destination of the relief route R4, even when the relief valve 22 is stuck open, coolant does not constantly flow into the radiator 15, and excessive cooling of the engine 10 due to the constant flow of coolant into the radiator 15 also does not occur. That is, with the engine cooling system according to the present embodiment, an excessive increase in coolant pressure at the multi-way valve upstream side is prevented, and the engine is not excessively cooled even when the relief valve 22 installed for the purpose of preventing an excessive increase in coolant pressure is stuck open.

With the above-described engine cooling system according to the present embodiment, the following advantageous effects are obtained.

(1) An excessive increase in coolant pressure at the multi-way valve upstream side is prevented by the installed relief route R4 in which the relief valve 22 is provided, and the engine cooling system according to the present embodiment prevents excessive cooling of the engine 10 even when the relief valve 22 installed for the purpose of preventing an excessive increase in coolant pressure is stuck open.

(2) It is also possible to prevent excessive cooling of the engine 10 at the time when the relief valve 22 is stuck open by monitoring whether the relief valve 22 is stuck open and, when it is determined that the relief valve 22 is stuck open, controlling the multi-way valve 14 such that the flow rate of coolant that is discharged to the radiator route R1 is reduced by the multi-way valve 14. However, in such a case, a sensor for monitoring whether the relief valve 22 is stuck open needs to be additionally installed, and this leads to an increase in the number of components. In this respect, with the engine cooling system according to the present embodiment, excessive cooling of the engine 10 at the time when the relief valve 22 is stuck open is prevented by just changing the relief destination of the relief route R4, so it is possible to reduce an increase in the number of components for preventing excessive cooling of the engine 10.

(3) The radiator route R1 having a larger passage cross-sectional area than the heater route R2 or the device route R3 is set for the relief destination of the relief route R4. For this reason, it is possible to quickly and reliably decrease the coolant pressure at the multi-way valve upstream side at the time when the relief valve 22 is opened as compared to when the heater route R2 or the device route R3 is set for the relief destination.

(4) It is possible to cause coolant to flow through the relief route R4 without causing coolant to flow into not only the radiator 15 but also the heater core 16 installed in the heater route R2 or the devices 17 to 21 installed in the device route R3. For this reason, at the time when the relief valve 22 is stuck open, it is possible not to unnecessarily supply coolant to the heater core 16 or the devices 17 to 21.

Next, a second embodiment of the engine cooling system will be described in detail additionally with reference to FIG. 7. In the present embodiment, like reference numerals denote components common to those of the above-described embodiment, and the detailed description thereof is omitted.

In the first embodiment, the relief destination of the relief route R4 is set to the portion downstream of the radiator 15 in the radiator route R1. Of course, even when the relief destination of the relief route R4 is set to any position as long as the portion is located downstream of the multi-way valve 14 and upstream of the coolant pump 13 in the coolant circuit and is other than a portion upstream of the radiator 15 in the radiator route R1, it is possible to achieve the purpose of preventing excessive cooling of the engine 10 at the time when the relief valve 22 is stuck open.

Figure 7:
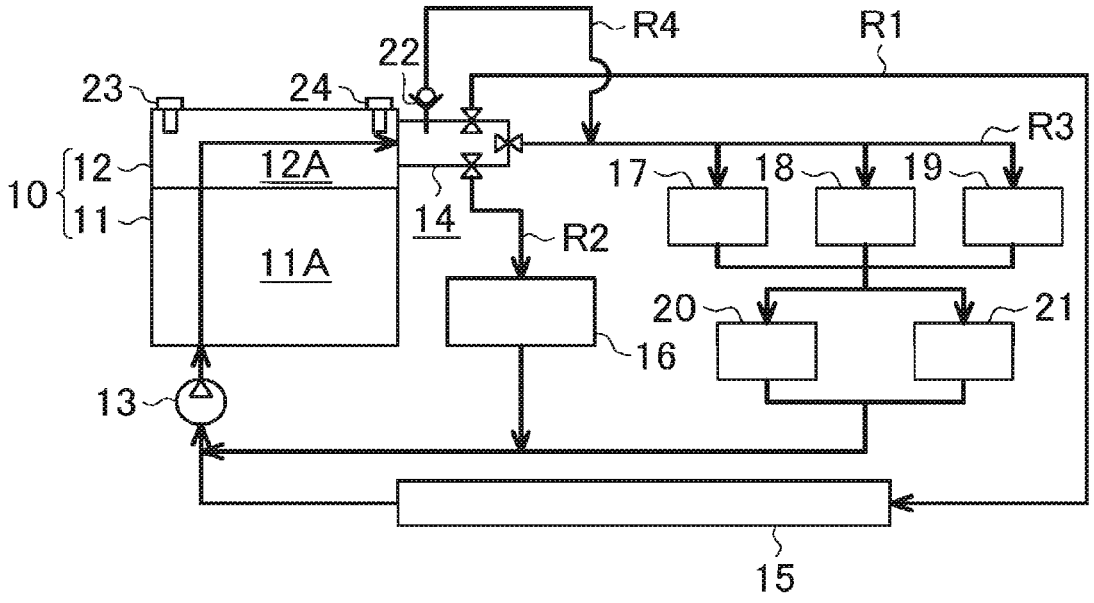
FIG. 7 is a schematic diagram that schematically shows the configuration of a coolant circuit in an engine cooling system according to a second embodiment.

As shown in FIG. 7, in the engine cooling system according to the present embodiment, the relief route R4 is provided so as to connect the inflow port 30F of the multi-way valve 14 to a portion upstream of the devices 17 to 21 in the device route R3 so as to bypass the multi-way valve 14. That is, in the engine cooling system according to the present embodiment, a portion upstream of the devices in the device route R3 is set for the relief destination of the relief route R4.

In the present embodiment as well, when the relief valve 22 is stuck open, coolant flows to the device route R3 through the relief route R4, and does not flow to the radiator 15 having a high cooling capacity for cooling coolant. For this reason, as in the case of the first embodiment, it is possible to prevent excessive cooling of the engine 10 at the time when the relief valve 22 is stuck open. In such a case, as compared to the case of the first embodiment, it is possible to shorten the distance between the relief source and relief destination of the relief route R4, and it is possible to further shorten piping (a pipe or a hose) that constitutes the relief route R4 or provide the whole relief route R4 inside the multi-way valve 14, so it is possible to reduce component cost.

The relief destination of the relief route R4 may be set to a portion other than the above-described portion in the device route R3 or may be set to the heater route R2. In such a case as well, it is possible to prevent excessive cooling of the engine 10 by avoiding a state where coolant constantly flows into the radiator 15 at the time when the relief valve 22 is stuck open. For information, considering a case where the heater is not used, when the relief destination of the relief route R4 is set to the heater route R2, it is more desirable that a portion downstream of the heater core 16 be set for the relief destination.

Next, a third embodiment of the engine cooling system will be described in detail additionally with reference to FIG. 8. In the first and second embodiment, the relief source of the relief route R4 is set to a portion at the inflow port 30F in the multi-way valve 14. Of course, even when the relief source of the relief route R4 is set to any portion as long as the portion is located downstream of the coolant pump 13 and upstream of the multi-way valve 14 in the coolant circuit, it is possible to achieve the purpose of preventing an excessive increase in coolant pressure at the multi-way valve upstream side.

Figure 8:
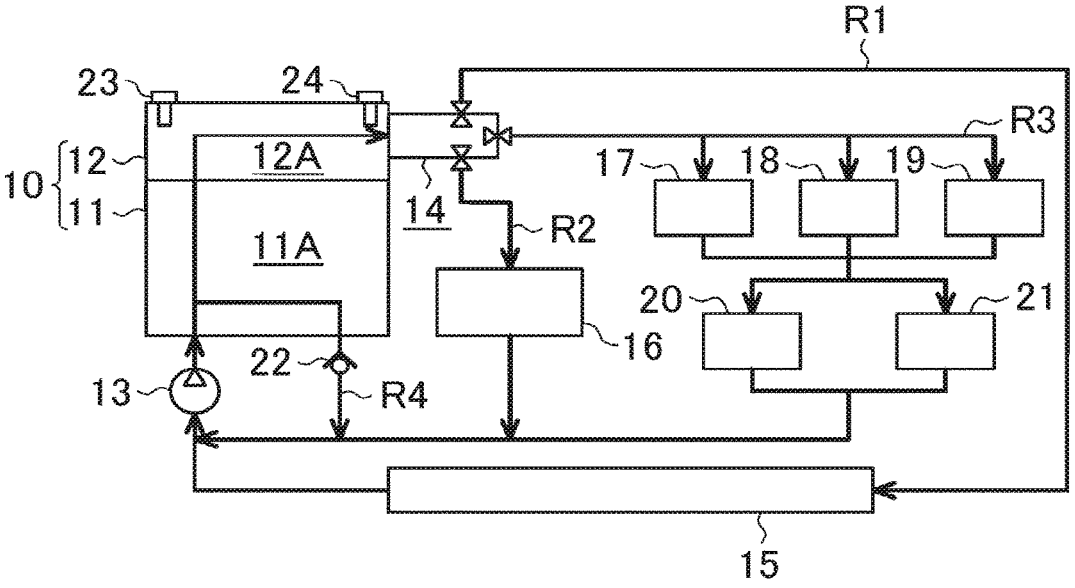
FIG. 8 is a schematic diagram that schematically shows the configuration of a coolant circuit in an engine cooling system according to a third embodiment.

As shown in FIG. 8, in the engine cooling system according to the present embodiment, the relief route R4 is provided so as to connect the water jacket 11A in the cylinder block 11 to a portion downstream of the devices 17 to 21 in the device route R3 so as to bypass the multi-way valve 14. The relief valve 22 is provided at an outlet portion from the water jacket 11A in the relief route R4. That is, in the present embodiment, the water jacket 11A is set for the relief source of the relief route R4.

According to the present embodiment as well, at the time when the coolant pressure at the multi-way valve upstream side has increased, it is possible to relieve the increased pressure through the relief route R4 by opening the relief valve 22. Because the relief destination of the relief route R4 is set to the device route R3, coolant does not constantly flow into the radiator 15 through the relief route R4 even at the time when the relief valve 22 is stuck open. Thus, with the engine cooling system according to the present embodiment as well, it is possible to prevent excessive cooling of the engine 10 at the time when the relief valve 22 is stuck open.

For information, with the engine cooling system according to the present embodiment, it is possible to cause coolant to flow through the relief route R4 without causing coolant to flow through the radiator 15, the heater core 16 or the devices 17 to 21 in the device route R3. For this reason, when the relief valve 22 is stuck open, it is possible not to unnecessarily supply coolant to the radiator 15, the heater core 16 or the devices 17 to 21 in the device route R3. When the relief route R4 is provided so as to connect the multi-way valve 14 to a portion downstream of the radiator 15 in the radiator route R1 as in the case of the engine cooling system according to the first embodiment, similar advantageous effects are obtained. However, if the multi-way valve 14 is mounted on the cylinder head 12 and the coolant pump 13 is mounted on the cylinder block 11, the path length of the relief route R4 may be long in the configuration according to the first embodiment. In such a case as well, when the relief source is set to the water jacket 11A of the cylinder block 11 as in the case of the present embodiment, the relief route R4 may be formed with a path length shorter than that in the case of the first embodiment.

The above-described embodiments may be modified into the following alternative embodiments. In the above-described embodiments, a differential pressure regulating valve is used as the relief valve 22. Instead, a thermostat valve that opens or closes in response to the temperature of coolant flowing into the thermostat valve may be employed as the relief valve 22. When an outflow of coolant from the multi-way valve 14 stagnates, the temperature of coolant together with the coolant pressure at the multi-way valve upstream side increases. For this reason, even when a thermostat valve is used as the relief valve 22, it is possible to relieve the coolant pressure at the multi-way valve upstream side.

In the above-described embodiments, the coolant circuit including three routes, that is, the radiator route R1, the heater route R2 and the device route R3, as the routes into which the coolant circuit is branched off from the multi-way valve 14 is illustrated. Instead, a similar relief structure may also be applied to an engine cooling system including a coolant circuit having a different number of routes into which the coolant circuit is branched off from the multi-way valve 14.

What is claimed is:

1. An engine cooling system comprising:

a coolant circuit through which coolant flows from a pump, passes through an inside of an engine and returns to the pump, the coolant circuit including a first route and a second route into which the coolant circuit is branched off at a branched position downstream of the inside of the engine, each of the first route and the second route being connected to the pump, the first route being a radiator route that passes through a radiator;

a multi-way valve that is provided at the branched position at which the coolant circuit is branched off into the first route and the second route and that is able to vary a flow rate ratio of coolant flowing into each of the first and second routes, the multi-way valve including an inflow port and a relief port;

a relief route that sets a relief source to a portion downstream of the pump and upstream of the multi-way valve in the coolant circuit, that sets a relief destination to a portion downstream of the multi-way valve and upstream of the pump in the coolant circuit, and that causes coolant to flow from the relief source to the relief destination so as to bypass the multi-way valve; and a relief valve that interrupts circulation of coolant through the relief route when the relief valve is closed, and that permits circulation of coolant through the relief route when the relief valve is open, wherein the relief destination is set to a portion downstream of the multi-way valve and upstream of the pump in the coolant circuit and other than a portion upstream of the radiator in the radiator route, the coolant that has flowed through the relief valve flows to the relief route, and the relief valve is installed at the relief port and is provided so as to be open to the inflow port.

2. The engine cooling system according to claim 1, wherein the relief valve is incorporated in the multi-way valve.

3. The engine cooling system according to claim 1, wherein the second route merges into the first route at a portion downstream of the radiator and upstream of the pump, and the relief route sets the second route for the relief destination, and causes coolant to flow from the relief source to the relief destination so as to bypass the multi-way valve.

4. The engine cooling system according to claim 1, wherein the multi-way valve further includes a first discharge port and a second discharge port, the multi-way valve comprising:

a housing, the housing including a main body, a first connector portion provided on a first side of the main body, and a second connector portion provided on a second side of the main body, the first connector portion being connected to the first route and the relief route, and a second connector portion being connected to the second route, and a valve element which is rotatable and accommodated at a lower portion of the main body, the valve element varying opening areas of the first discharge port and the second discharge port, the valve element presenting a hollow structure with an opening in fluid communication with the inflow port and including upper and lower barrel-shaped portions, the upper portion including a first hole which communicates with the first port in a first valve phase range, the lower portion including a second hole which communicates with the second port in a second valve phase range, and wherein the relief valve is installed at the relief port and is provided so as to be open to the inflow port without intervening in an accommodation space for the valve element.

5. The engine cooling system according to claim 4, wherein a groove is provided in an upper face of the valve element, and a portion of the upper face of the valve element does not include the groove.

* * * * *